US005927774A

United States Patent [19]

Granger

[11] Patent Number: 5,927,774

[45] **Date of Patent: *Jul. 27, 1999**

[54] DOOR LOCK BRACKET AND METHOD OF MAKING SAME

[75] Inventor: Timothy Paul Granger, Fraser, Mich.

[73] Assignee: Zenith Industrial Corporation, Clinton Township, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/441,984

[22] Filed: May 16, 1995

Related U.S. Application Data

[63] Continuation of application No. 08/115,516, Sep. 1, 1993, abandoned.

[51] Int. Cl.[6] ..... F05B 15/02

[52] U.S. Cl. ..... 292/340; 292/216

[58] Field of Search ..... 292/340, 341.12, 292/341.13, 216, 337, DIG. 40, DIG. 56

[56] References Cited

U.S. PATENT DOCUMENTS

| | | | |
|---|---|---|---|
| 2,446,206 | 8/1948 | Beckman . | |
| 3,316,007 | 4/1967 | Russell . | |
| 3,591,225 | 7/1971 | Hagemeyer . | |
| 4,466,645 | 8/1984 | Kobayashi . | |
| 4,470,626 | 9/1984 | Gergoe . | |
| 4,703,960 | 11/1987 | Lense . | |
| 4,733,892 | 3/1988 | Kleefeldt et al. . | |
| 4,756,565 | 7/1988 | Myslicki et al. | 292/340 |
| 4,883,298 | 11/1989 | Kleefeldt . | |
| 4,941,696 | 7/1990 | Yamada et al. . | |
| 4,946,208 | 8/1990 | Myslicki et al. | 292/DIG. 53 X |
| 4,981,313 | 1/1991 | Makamura | 292/340 |
| 4,998,759 | 3/1991 | Peterson et al. | 292/340 |
| 5,050,917 | 9/1991 | Hamada et al. | 292/340 |
| 5,106,134 | 4/1992 | Thau . | |
| 5,125,698 | 6/1992 | Thau . | |
| 5,172,946 | 12/1992 | Dowling . | |
| 5,209,531 | 5/1993 | Thau | 292/216 |
| 5,215,342 | 6/1993 | Yuge et al. | 292/340 |
| 5,263,752 | 11/1993 | Phail-Fausey et al. | 292/340 |

*Primary Examiner*—Darnell M. Boucher
*Attorney, Agent, or Firm*—Vanophem Meehan & Vanophem, P.C.

[57] ABSTRACT

A door lock bracket for serving as a striker which secures an automobile door closed in conjunction with a door latching assembly. The door lock bracket is formed from a one-piece stamping which includes a flange portion for mounting the door lock bracket to the door post of the automobile, an apertured portion for receiving the door's latching mechanism, and a base portion interconnecting the flange and apertured portions. The door lock bracket is structurally uncomplicated, so as to facilitate the manufacture of the door lock bracket using a relatively simple multiple-step bending operation. As a result, the door lock bracket is relatively inexpensive to manufacture, yet can be formed to be strong and structurally rigid for extended and repeated use throughout the life of the automobile.

6 Claims, 3 Drawing Sheets

DOOR LOCK BRACKET AND METHOD OF MAKING SAME

This is a continuation of application Ser. No. 08/115,516, filed Sep. 1, 1993 now abandoned.

BACKGROUND OF THE INVENTION

1. Field of the Invention

The present invention generally relates to automobile door lock brackets which secure the door of an automobile in a closed position by serving as a striker for a door latching mechanism. More specifically, this invention relates to a door lock bracket which can be readily manufactured as a one-piece stamping, rendering a strong and rigid bracket which can be manufactured at a relatively low cost.

2. Description of the Prior Art

Automobile doors are conventionally secured in a closed position with a latching mechanism that is mounted to the door, which engages a striker mounted to the door post. Often, the latching mechanism is a spring-loaded slotted or fork-shaped member whose slot engages a portion of the striker when the door is closed. To accommodate this type of latching mechanism, typical striker designs include a post which extends perpendicularly from the door post, as illustrated in U.S. Pat. No. 3,591,225 to Hagemeyer, or a U-shaped tubular member as illustrated in U.S. Pat. No. 4,466,645 to Kobayashi, U.S. Pat. No. 4,470,626 to Gergoe et al. and U.S. Pat. No. 4,941,696 to Yamada et al. The U-shaped strikers also generally extend perpendicularly from the door post, with the latching mechanism straddling a single leg of the U-shaped fork when the door is closed, such that one leg of the fork extends through the opening formed by the U-shaped striker with the door post.

While the above types of strikers are relatively simple in their design, the fabrication of such strikers can be somewhat complicated, often requiring the forming and machining of an extrusion. Such processing steps generally result in a relatively expensive component, which is highly undesirable in the competitive automotive industry.

In comparison, strikers formed from stampings offer the potential for a less expensive component, in view of the simplified processing involved. Such stamped strikers are known in the art, as evidenced by U.S. Pat. No. 4,733,892 to Kleefeldt et al., U.S. Pat. No. 4,883,298 to Kleefeldt, and U.S. Pat. Nos. 5,106,134 and 5,125,698 to Thau. Generally, the strikers taught by Kleefeldt et al. and Kleefeldt are somewhat complicated in their shape, and require some degree of assembly. The striker taught by Kleefeldt et al. includes a wedge-shaped body from which a pair of flanges extend oppositely for mounting the striker to the door post of an automobile. Each side of the wedge has an aperture formed therein for receiving a leg of a fork-shaped latching mechanism. The striker taught by Kleefeldt includes a U-shaped yoke, one leg of which is enlarged to form a pair of flanges for mounting the striker to the door post. A bolt extends between the legs of the U-shaped yoke and supports a hardened sleeve for engaging and receiving a fork-shaped latching mechanism. The strikers taught by Kleefeldt et al. and Kleefeldt each require a sequence of stamping operations, as well as some degree of assembly, all of which add undesirable costs to the final end product.

The strikers taught by Thau are also somewhat complicated by their geometry. Both teach a rectangular-shaped head member composed of a pair of members which are folded onto each other, such that the members are juxtaposed. Each juxtaposed member includes a flange which extends perpendicular from the head member for mounting the striker to the door post. The juxtaposed members each have an aperture which are aligned to form an opening in the head member for receiving one leg of a fork-shaped latching mechanism. In addition, the juxtaposed members are formed to provide a wedge-shape to the head member. While the strikers taught by Thau are somewhat less complicated than that taught by Kleefeldt and Kleefeldt et al., in that they are a one-piece stamping, it is apparent that their structure requires a relatively complicated sequence of stamping operations, which again contributes undesirable costs to the final end product.

From the above discussion, it can be readily appreciated that the prior art does not disclose a relatively inexpensive one-piece striker for an automobile door which can be readily manufactured from a single stamping without the requirement for a complex forming sequence, assembly and/or geometry. Consequently, such strikers are relatively expensive to manufacture, resulting in additional and undesirable costs to the overall price of an automobile. In addition, the complexity of such strikers complicates their repair and replacement, which increases warranty repair costs for the manufacturer and/or has the potential for passing on repair costs to the consumer.

Accordingly, what is needed is a relatively inexpensive striker for an automobile door, wherein the striker is characterized by an uncomplicated geometry so as to facilitate its manufacture from a single stamping, and wherein the striker is compatible with conventional slotted or fork-shaped latching mechanisms used in the automotive industry.

SUMMARY OF THE INVENTION

According to the present invention there is provided a door lock bracket suitable for use with a slotted or fork-shaped latching mechanism to secure a door of an automobile in a closed position. The door lock bracket is formed from a one-piece stamping which requires only a single flange portion for mounting the door lock bracket to the door post of the automobile, and a single apertured portion for receiving the door's latching mechanism. Accordingly, the door lock bracket is structurally uncomplicated. Furthermore, the uncomplicated structure of the door lock bracket facilitates its manufacture through a simple two-step bending operation. As a result, the door lock bracket of this invention is relatively inexpensive to manufacture, which is a highly desirable advantage in the automotive industry. In addition, the configuration of the door lock bracket promotes its strength and structural rigidity for repeated use throughout the life of the automobile.

The door lock bracket includes a flange portion for mounting the door lock bracket to a suitable support member, such as the door post of an automobile, an apertured portion having an aperture sized to receive a leg of a slotted or fork-shaped latching mechanism, and a base portion intermediate and interconnected with the flange and apertured portions. The flange portion, base portion and apertured portion together define a unitary stamped member. The base portion has a first deformed region which joins the flange portion to the base portion such that the flange portion is substantially perpendicular to the base portion. The base portion further has a second deformed region disposed opposite the first deformed region. The second deformed region joins the apertured portion to the base portion such that the apertured portion is also substantially perpendicular to the base portion. Preferably, the apertured portion is also oriented to be substantially perpendicular to the flange portion. As such, when the door lock bracket is secured to the door post with the flange portion, the apertured portion will extend perpendicularly from the door post so as to provide a suitable striker for the door's latching mechanism. To structurally reinforce the door lock bracket, it is preferable that the apertured portion abut the flange portion, and more preferably, that the apertured portion be permanently joined to the flange portion by welding or brazing.

The method by which the door lock bracket of this invention is manufactured generally includes forming a substantially planar member having the flange portion, the apertured portion oppositely disposed from the flange portion, and the base portion intermediate the flange portion and the apertured portion. In such a configuration, the planar member generally has a U-shape, with the flange and apertured portions forming the legs of the U. The base portion is then bent so as to orient the apertured portion to be substantially perpendicular to the flange portion. Generally, the bending operation involves bending a first portion of the base portion such that the flange portion is substantially perpendicular to the base portion, and then bending a second portion of the base portion such that the flange portion is also substantially perpendicular to the base portion, as well as the apertured portion. Consequently, there are generally three defined planar portions of the door lock bracket, each of which is substantially perpendicular to the other portions. As indicated above, a preferred additional processing step is to permanently join the flange portion to the apertured portion after the bending step via a welding or brazing operation.

According to a preferred aspect of this invention, the above structure and method for forming the door lock bracket is relatively simple, particularly in comparison to prior art strikers. The entire door lock bracket is formed from a single stamping, with the only additional hardware required being fasteners for mounting the door lock bracket to the door post. Because the door lock bracket is structurally uncomplicated, its installation is also uncomplicated, both features being highly desirable in terms of installation on a mass production assembly line. Such features are also desirable from the standpoint of repairs and replacement, whether during assembly of the automobile or any time thereafter.

In addition, a significant advantage of the present invention is that the manner by which the door lock bracket can be manufactured is relatively uncomplicated, primarily requiring only stamping and bending operations. Accordingly, the cost for manufacturing the door lock bracket can potentially be significantly less than that for other strikers known in the prior art. The simplified manufacturing process involved in forming the door lock bracket also has the advantageous effect of reducing manufacturing expenses resulting from the cost of the equipment used to form the bracket, as well as their maintenance and repair.

Accordingly, it is an object of the present invention to provide a door lock bracket for securing a door of an automobile in a closed position in conjunction with a latching mechanism mounted to the door.

It is a further object of the invention that the door lock bracket be structurally uncomplicated, such that a minimal number of manufacturing processes are required to fabricate the door lock bracket, yet structurally strong and rigid for repeated use throughout the life of the automobile.

It is still a further object of the invention that the door lock bracket be composed primarily of a flange portion for mounting the door lock bracket to the automobile, and an apertured portion which serves as a striker for the latching mechanism of the door.

It is another object of the invention to provide a relatively low cost method for manufacturing the door lock mechanism of this invention.

It is yet another object of the invention that the method primarily consists of stamping and bending operations.

Other objects and advantages of this invention will be more apparent after a reading of the following detailed description taken in conjunction with the drawings provided.

DETAILED DESCRIPTION OF THE PREFERRED EMBODIMENT

Figure 1:
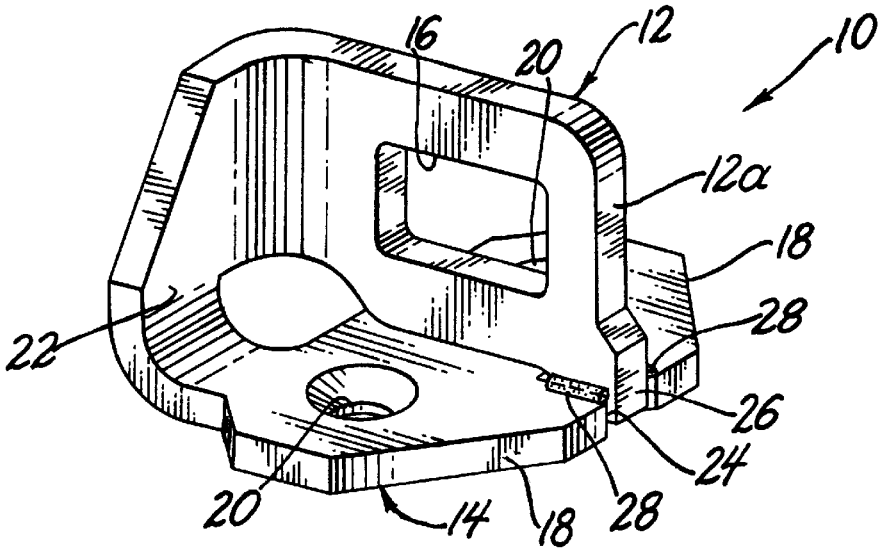
FIG. 1 is a perspective view of a door lock bracket in accordance with a preferred embodiment of this invention.
Figure 2:
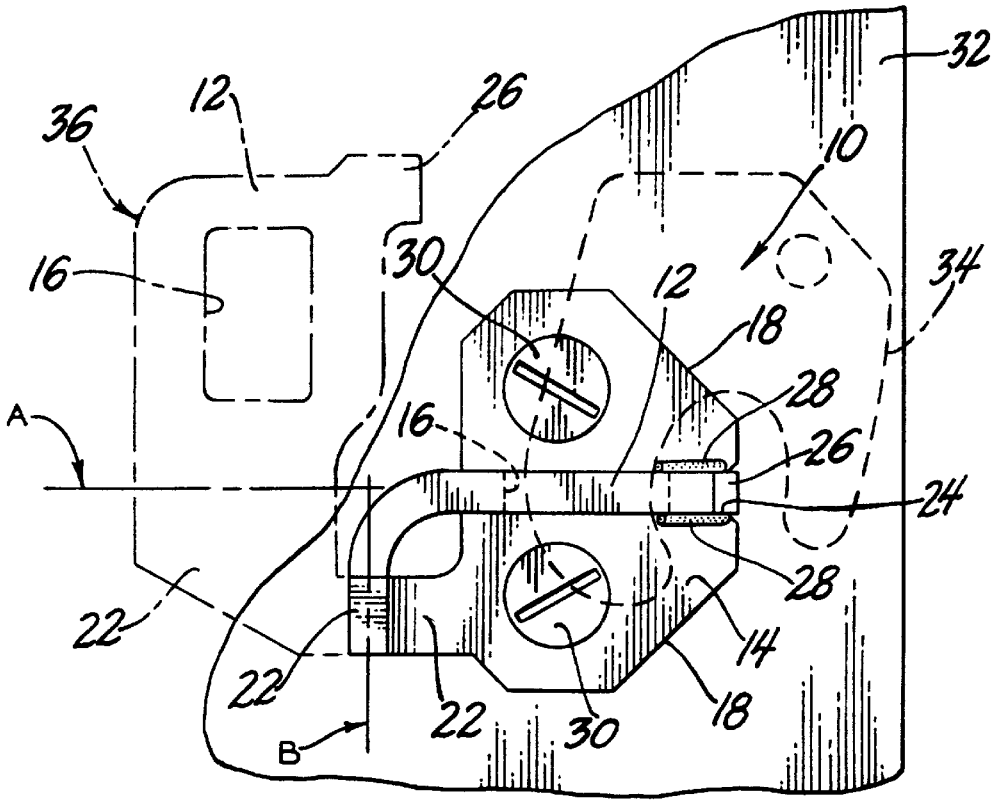
FIG. 2 is a side view of the door lock bracket of FIG. 1, illustrating in phantom lines the as-stamped configuration of the door lock bracket as well as a slotted latching mechanism suitable for use in conjunction with the door lock bracket.

With reference to FIGS. 1 and 2, there is shown a door lock bracket 10 in accordance with a preferred embodiment of this invention. As illustrated, the door lock bracket 10 is composed of a one-piece stamping which is formed through a series of bending operations to form a striker for a door of an automobile (not shown). The following description will specifically refer to the use of the present invention within the environment of an automobile passenger door for purposes of clarity, so as to assist in an understanding of the disclosure. However, the teachings of the present invention are not limited to automobile passenger doors, and can be readily adapted by one skilled in the art to other automotive applications, such as a striker for the trunk or hatch of an automobile, as well as non-automotive applications.

The door lock bracket 10 of this invention generally includes an apertured portion 12, a flange portion 14 and a base portion 22. The apertured portion 12 has an aperture 16 formed therein which is preferably rectangular in shape. As can be seen in FIG. 2, the shape and size of the aperture 16 are predetermined to receive one leg of a latch 34 of a door latching mechanism, for the purpose of securing the door in a closed position. The flange portion 14 is generally wedge-shaped by a pair of beveled portions 18, and includes a pair of mounting holes 20 through which a corresponding pair of fasteners 30 are inserted for mounting the door lack bracket 10 to a door post 32 of the automobile. As is conventional, the mounting holes 20 may be countersunk to enable the fasteners 30 to be installed flush with the surface of the flange portion 14.

As best seen in FIG. 2, the apertured portion 12 is oriented relative to the flange portion 14 so as to generally partition the flange portion 14 into two substantially symmetrical halves, each of which includes one of the mounting holes 20. To add structural rigidity to this configuration, a tab 26 is preferably formed on the apertured portion 12 for engaging a slot 24 formed in the flange portion 14, so as to stabilize the position of the apertured portion 12 relative to the flange portion 14. In addition, the apertured and flange portions 12 and 14 are preferably welded together so as to form a weld joint 28 which secures the tab 26 within the slot 24.

Prior to forming, the as-stamped configuration of the door lock bracket 10 is generally a U-shaped planar member 36, shown in phantom in FIG. 2. The apertured and flange portions 12 and 14 define legs of the U-shaped planar member 36, with the base portion 22 defining the base of the U so as to interconnect the apertured and flange portions 12 and 14. To form the door lock bracket 10, the U-shaped planar member 36 is bent along line A to orient the apertured portion 12 to be substantially perpendicular to the base portion 22, and along line B to orient the flange portion 14 to also be substantially perpendicular to the base portion 22. In so doing, the tab 26 of the apertured portion 12 is brought into engagement with the slot 24 of the flange portion 14, such that the apertured portion 12 is oriented to be substantially perpendicular to the flange portion 14.

Obviously, the perpendicular relationships described above are provided in terms of a preferred embodiment. It is well within the scope of one skilled in the art to alter the orientations of the individual members of the door lock bracket 10 to be other than perpendicular. Accordingly, while the present invention will generally be discussed in terms of the apertured portion 12 being substantially perpendicular to the flange portion 14 and base portion 22, the teachings of the present invention are not to be interpreted as being limited to this specific configuration.

The method by which the door lock bracket 10 of this invention is formed from the U-shaped planar member 36 is generally as follows. The U-shaped planar member 36 can generally be stamped in accordance with conventional practices, which include forming the aperture 16, mounting holes 20, and slot 24. Alternatively, such features may be formed by secondary machining operations, though at a relatively higher cost.

Most preferably, the material for the door lock bracket 10 is a high-strength low-alloy (HSLA) steel, such as SAE 1050 or SAE 1065, which is a material noted for its toughness. However, it is foreseeable that the mechanical properties required will vary according to the particular application for the door lock bracket 10, such that low carbon and other low-alloy steels could be used. The choice of material affects the required thickness of the U-shaped planar member 36 for a given application. For the preferred 950C material, a thickness of about five millimeters has been found to be suitable for use with an automobile passenger door, though greater or lesser thicknesses may be preferred, depending on the requirements for the application.

Figure 3:
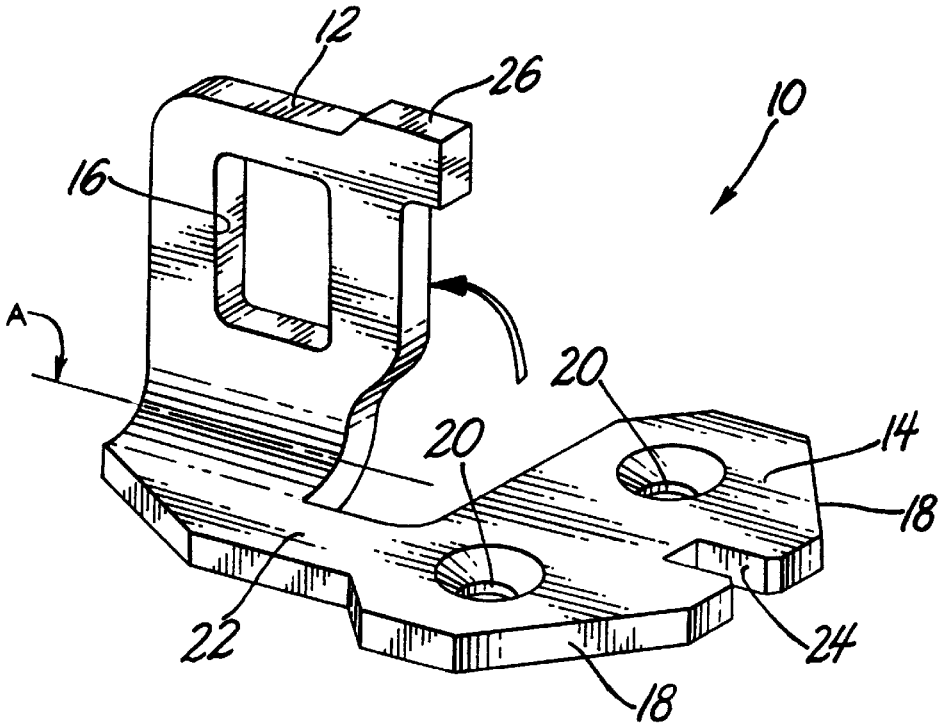
FIG. 3 is a perspective view illustrating a first bending operation used in the fabrication of the door lock bracket of FIG. 1.

Once the desired shape of the U-shaped planar member 36 is obtained, and the aperture 16 and mounting holes 20 have been formed therein, the apertured and flange portions 12 and 14 are bent relative to the base portion 22 to attain the configuration shown in FIG. 1. As illustrated in FIG. 3, it is preferable to form an approximately 90 degree bend along line A to properly orient the apertured portion 12 relative to the base portion 22. As is well known in the art, such an operation involves plastically deforming the region of the base portion 22 along line A. It is noted that conventional practices for controlling the amount of distortion in the plastically deformed region, as well as the prevention of tears and surface fractures in this region, should be adopted to ensure the structural integrity of the door lock bracket 10, as is within the scope of one skilled in the art.

Figure 4:
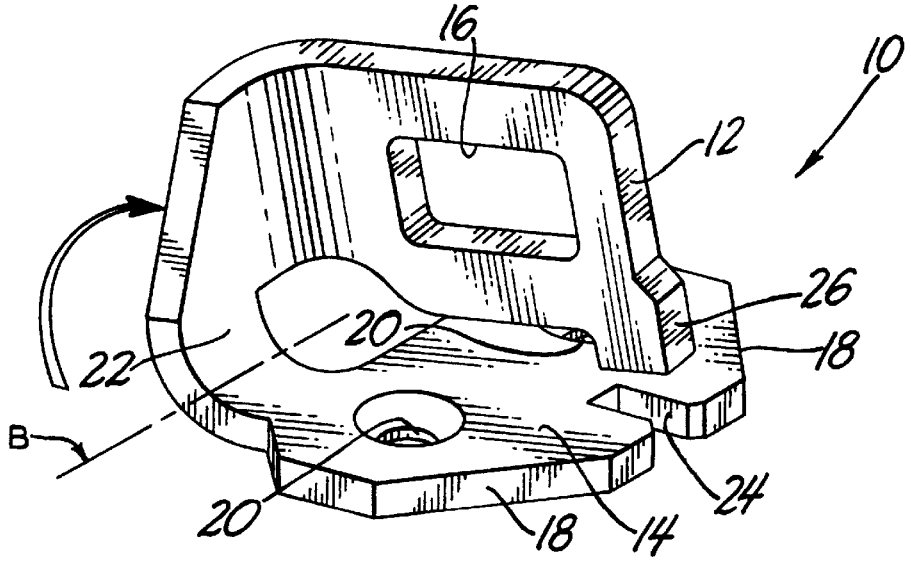
FIG. 4 is a perspective view illustrating a second bending operation used in the fabrication of the door lock bracket of FIG. 1.

FIG. 4 illustrates the second bending operation, which involves forming an approximately 90 degree bend along line B to properly orient the apertured portion 12 relative to the flange portion 14. Preferably, and as shown, this bending operation results in the flange portion 14 being oriented substantially perpendicular to the base portion 22, such that the axis of the aperture 16 is substantially parallel to the flange portion 14. As can be seen in FIG. 4, the bend between the flange portion 14 and the base portion 22 is preferably formed last so as to enable the tab 26 projecting from the apertured portion 12 to properly engage the slot 24 formed in the flange portion 14. However, it is foreseeable that the operations could be reversed, particularly if the tab 26 and slot 24 are omitted from the structure of the door lock bracket 10. Following this final bending operation, the weld joint 28 shown in FIG. 1 can be formed as a secondary operation to permanently attach the apertured portion 12 to the flange portion 14 by securing the tab 26 within the slot 24.

As a result of the above method, the apertured portion 12 forms a striker 12*a* against which the latch 34 forcibly engages to secure the door in a closed position. To promote the dimensional accuracy of the striker 12*a*, as well as its strength and hardness, it is preferable to coin the region of the apertured portion 12 corresponding to the striker 12*a* in accordance with conventional practices well known to those skilled in the art. Such an operation can be most readily performed before the bending operations described above, though coining the striker 12*a* after the bending operations is also foreseeable.

Figure 5:
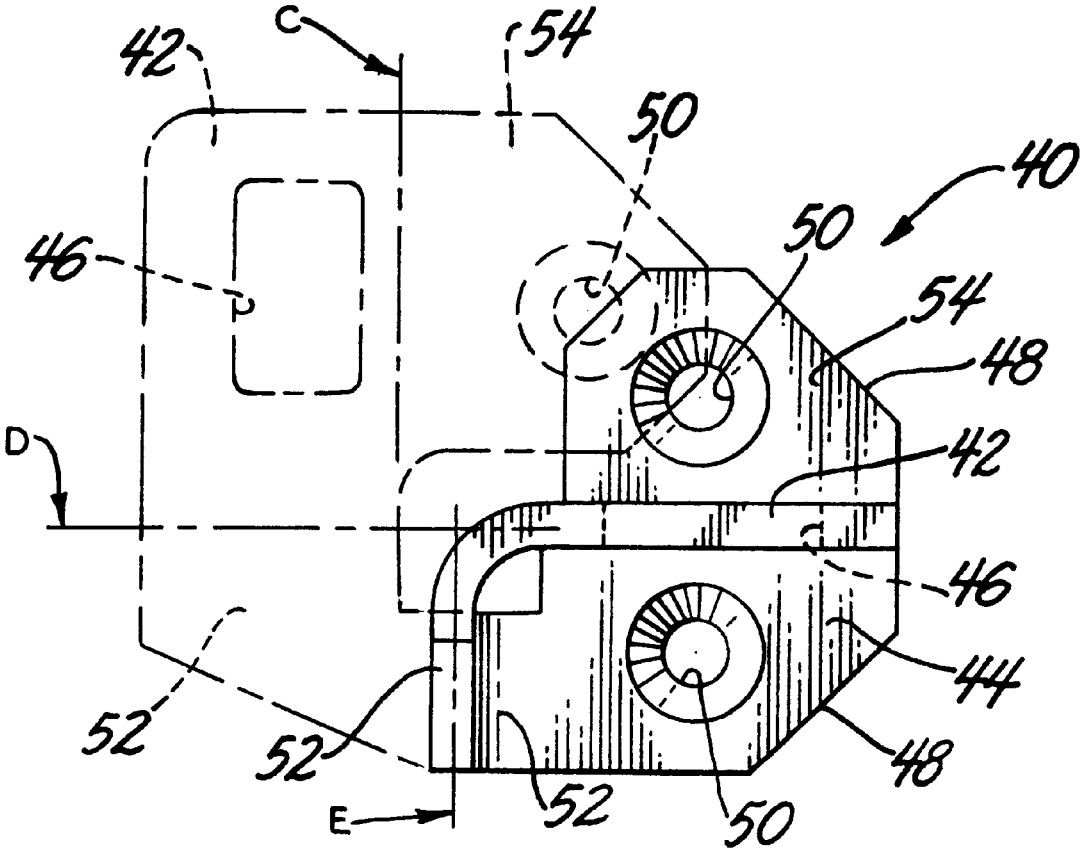
FIG. 5 is a side view of a door lock bracket in accordance with a second embodiment of this invention, illustrating in phantom lines the as-stamped configuration of the door lock bracket.

FIG. 5 illustrates a door lock bracket 40 in accordance with a second embodiment of this invention. After forming, the door lock bracket 40 generally has the same appearance as the door lock bracket 10 of the first embodiment. The door lock bracket 40 includes an apertured portion 42, a flange portion 44 and a base portion 52. The apertured portion 42 includes a rectangular hole 46 for receiving one leg of a slotted latch (not shown), while the flange portion has beveled edges 48 and includes a pair of countersunk mounting holes 50.

However, the as-stamped configuration of the door lock bracket 40 differs from that of the first embodiment, as can be seen from the outline shown in phantom. The primary difference is that a flange section 54 is formed contiguously with the apertured portion 42, with the flange portion 44 being roughly half of that shown in FIGS. 1 through 4. Consequently, the bending operation involves forming a third bend along line C to orient the flange section 54 to be substantially perpendicular to the apertured portion 42. Otherwise, the bending operations include forming an approximately 90 degree bend along lines D and E, corresponding to lines A and B of FIG. 2. Most preferably, the apertured portion 42 will be welded to the flange portion 44 to impart added rigidity to the door lock bracket 40.

From the above, it can be seen that a significant advantage of the door lock brackets 10 and 40 of the present invention is that they are structurally strong and rigid, yet relatively uncomplicated, particularly in comparison to prior art strikers formed from extrusions or stampings. The door lock brackets 10 and 40 are each formed from a single stamping, and require additional hardware only for the purpose of mounting the door lock brackets 10 and 40 to a door post. Because the door lock brackets 10 and 40 are structurally uncomplicated, their installation, repair and replacement are also relatively uncomplicated, which is highly desirable in terms of mass production practices in the automotive industry. Furthermore, ease of installation, repair and replacement are also important from the standpoint of minimizing repair and replacement costs, whether during assembly of the automobile, while under warranty by the manufacturer, or at the expense of the consumer.

In addition, a significant advantage of the present invention is that the method by which the door lock brackets 10 and 40 are formed is relatively uncomplicated, primarily requiring only stamping and bending operations. Accordingly, the cost for producing the door lock brackets 10 and 40 is potentially significantly less than that for other forms of strikers known in the prior art. The simplified forming process involved in manufacturing the door lock brackets 10 and 40 also potentially has the advantageous effect of reducing manufacturing expenses attributable to the cost of the equipment used to form the brackets, as well as the maintenance and repair of such equipment.

In addition, with minimal modifications the advantages of the door lock brackets 10 and 40 of this invention can be realized when used with other latching mechanisms and within other applications.

Accordingly, the present invention provides a door lock bracket which serves as a striker for securing a door closed in conjunction with a door latching assembly. The door lock bracket is formed from a one-piece stamping which is composed primarily of a flange portion for mounting the door lock bracket to the door post of an automobile, and an apertured portion for receiving the door's latching mechanism. The door lock bracket is, therefore, structurally uncomplicated, so as to facilitate the manufacture of the door lock bracket using a relatively simple multiple-step bending operation. As a result, the door lock bracket of this invention is relatively inexpensive to manufacture, which is a highly desirable advantage in the automotive industry.

While the invention has been described in terms of a preferred embodiment, it is apparent that other forms could be adopted by one skilled in the art. For example, the size and shape of the apertured and flange portions 12 and 14 could be altered from that shown in the drawings, the apertured portion 12 could be positionally maintained relative to the flange portion 14 with another suitable feature other than the tab 26 and slot 24 or weld 28, and the door lock brackets 10 and 40 could be adapted for use in applications other than the passenger door of an automobile. Accordingly, the scope of the invention is to be limited only by the following claims.

What is claimed is:

1. A one piece stamped door lock bracket comprising:

a base portion having one end and an opposite end;

a planar flange portion complementary with and attached to said one end of said base portion;

an apertured portion having one end complementary with and attached to said opposite end of said base portion, said apertured portion having an upstanding flange integral with said opposite end of said base portion and disposed transverse to said planar flange portion, said apertured portion extending in a direction perpendicular to both said planar flange portion attached to said one end of said base portion and said upstanding flange at said one end of said apertured portion attached to said opposite end of said base portion;

an aperture in said opposite end of said apertured portion; and means for securing said opposite end of said apertured portion to said planar flange portion complementary with and attached to said one end of said base portion.

2. A one piece stamped door lock bracket comprising:

a base portion having one end and an opposite end, a planar flange portion complementary with and attached to said one end of said base portion, and an apertured portion having one end complementary with said opposite end of said base portion and an opposite end extending in a direction away from said base portion;

a first transversely deformed portion interposed between said base portion and said apertured portion, said first transversely deformed portion deforming said apertured portion with respect to said base portion such that said apertured portion is substantially perpendicular to said planar flange portion of said base portion;

a second transversely deformed portion integral with said apertured portion of said opposite end of said base portion, said second transversely deformed portion deforming said apertured portion with respect to said one end of said base portion such that said apertured portion is substantially perpendicular to said one end of said base portion and said first transversely deformed portion; and means for securing said opposite end of said apertured portion to said planar flange portion.

3. The door lock bracket of claim 2 wherein said securing means comprises a permanent joint attaching said apertured portion to said planar flange portion.

4. The door lock bracket of claim 1 wherein said aperture has an axis which is substantially parallel to said planar flange portion.

5. The door lock bracket of claim 2 wherein said apertured portion partitions said planar flange portion into substantially symmetrical halves.

6. The door lock bracket of claims 2 wherein said second transversely deformed portion is aligned substantially perpendicular to said first transversely deformed portion.

* * * * *

UNITED STATES PATENT AND TRADEMARK OFFICE

CERTIFICATE OF CORRECTION

PATENT NO. : 5,927,774
DATED : July 27, 1999
INVENTOR(S) : Timothy P. Granger

It is certified that error appears in the above-identified patent and that said Letters Patent is hereby corrected as shown below:

Column 4, line 58, kindly delete "lack" and insert ---- lock ----.

Signed and Sealed this

Seventeenth Day of October, 2000

*Attest:*

Q. TODD DICKINSON

*Attesting Officer*

*Director of Patents and Trademarks*